US006189658B1

(12) United States Patent
Karner

(10) Patent No.: US 6,189,658 B1
(45) Date of Patent: Feb. 20, 2001

(54) PROCEDURE FOR MOVING THE LANDING DOOR OF AN ELEVATOR, AND A DOOR COUPLER

(75) Inventor: Franz Josef Karner, St. Anton (AT)

(73) Assignee: Kone Corporation (FI)

( * ) Notice: Under 35 U.S.C. 154(b), the term of this patent shall be extended for 0 days.

(21) Appl. No.: 09/029,982

(22) PCT Filed: Sep. 13, 1996

(86) PCT No.: PCT/FI96/00487

§ 371 Date: Apr. 17, 1998

§ 102(e) Date: Apr. 17, 1998

(87) PCT Pub. No.: WO97/10169

PCT Pub. Date: Mar. 20, 1997

(30) Foreign Application Priority Data

Sep. 13, 1995 (FI) ..... 954307

(51) Int. Cl.[7] ..... B66B 13/12
(52) U.S. Cl. ..... 187/319; 187/309
(58) Field of Search ..... 187/314, 319, 187/330, 335, 307–310; 49/120, 116

(56) References Cited

U.S. PATENT DOCUMENTS

| | | | | |
|---|---|---|---|---|
| 2,094,385 | | 9/1937 | Vanderzee . | |
| 2,193,860 | * | 3/1940 | Crane | 187/319 |
| 3,065,826 | * | 11/1962 | Tucker, Jr. | 187/319 |
| 3,605,952 | | 9/1971 | Lusti . | |
| 3,783,977 | * | 1/1974 | Voser | 187/319 |
| 4,148,377 | | 4/1979 | Foelix et al. . | |
| 4,947,964 | * | 8/1990 | Husmann | 187/319 |
| 5,246,089 | * | 9/1993 | Husmann et al. | 187/319 |
| 5,377,785 | * | 1/1995 | Pearson | 187/335 |
| 5,730,254 | * | 3/1998 | NGuyen | 187/335 |
| 5,950,766 | * | 9/1999 | Oberleitner | 187/330 |
| 5,988,320 | * | 11/1999 | Mittermayr | 187/319 |

FOREIGN PATENT DOCUMENTS

0679602A1 11/1995 (EP) .

* cited by examiner

*Primary Examiner*—Robert P. Olszewski
*Assistant Examiner*—Thuy V. Tran
(74) *Attorney, Agent, or Firm*—Birch, Stewart, Kolasch & Birch, LLP

(57) ABSTRACT

The landing door of an elevator is opened by the opening movement of the car door and closed by the closing movement of the car door by using a door coupler (20) attached to the car door. The door coupler has coupling elements (52,53) designed to engage a counterpart (6) attached to the landing door. The door coupler (20) is moved in the direction of the car door movement to align it with the counter element (6). After the door coupler (20) has been aligned, its motion relative to the car door is prevented by a blocking device (28).

15 Claims, 4 Drawing Sheets

PROCEDURE FOR MOVING THE LANDING DOOR OF AN ELEVATOR, AND A DOOR COUPLER

This application is the national phase under 35 U.S.C. §371 of prior PCT International Application No. PCT/FI 96/00487 which has an International filing date of Sep. 13, 1996 which designated the United States of America, the entire contents of which are hereby incorporated by reference.

FIELD OF THE INVENTION

The present invention relates to a procedure for moving the landing door of an elevator and to a door coupler.

DESCRIPTION OF THE BACKGROUND ART

In elevators provided with automatic doors, the landing door is generally moved by the car door. The coupling between the car door and the landing door is implemented using a door coupler which is mounted on the car door and engages counterparts mounted on the landing door by means of its gripping elements. The door coupler and the counterparts are so fitted relative to each other that, when the elevator car is moving past the landing door, the counterparts on the landing door are passed between the gripping elements of the door coupler. When the car is at a landing and the car doors are moving, the door coupler is in engagement with the counterparts. In this way, the landing door also moves when the car door is moved by a power means connected to the car door. Often the gripping elements are metal vanes projecting from the door coupler towards the landing door and forming a kind of a vertical slot which is open towards the landing door. The counterparts used often consist of rollers mounted on the landing door and projecting from the door towards the elevator shaft, the axle of the rollers being mounted in a position perpendicular to the plane of the door.

When an elevator car stops at a landing, usually the elevator car and the landing devices are not exactly aligned with each other, but either the location or position, or both, of the elevator car differs at least somewhat from the ideal location or position with respect to the equipment at the landing. For this reason, there are problems with the coupling between the car door and landing door, because inadequate ligament between the door coupler and the counterparts may lead to a host of various problems. If the door coupler is not properly aligned with the rollers on the landing door, this may result in noise, reliability problems, interruption of door operation, obstruction of emergency opening of the door, incomplete opening or closing movement of the door, etc.

SUMMARY OF THE INVENTION

In order to overcome the aforesaid problems relating to the opening and closing of elevator doors and the coupling between the car door and landing door, a procedure for moving the landing door of an elevator is presented as an invention. Furthermore, a new type of door coupler for an elevator door is presented as an invention.

The procedure of the invention comprises the steps of providing a door coupler attached to the car door; coupling the car door to the landing door with the door coupler when the elevator is stopped at a landing; engaging a counterpart mounted on the landing door with gripping elements provided on the door coupler during the step of coupling; aligning the door coupler according to a position of the counterpart by moving the door coupler in relation to the car door in a direction of car door movement; and preventing movement of the door coupler relative to the car door after the step of aligning. The door coupler of the invention comprises gripping elements for engaging a counterpart attached to a landing door when the elevator is stopped at a landing; a blocking device to prevent relative motion between the door coupler and the car door, the door coupler being movably mounted relative to a direction of car door movement.

The advantages provided by the invention include the following:

- The invention ensures a reliable coupling between the car door and landing door and complete closing of the doors even if they are not exactly aligned with each other.
- The drawbacks of inadequate or unsuccessful coupling, such as clatter and noise, interruption of door operation, the doors getting stuck, etc. are avoided.
- The invention is applicable for use with both side-opening and center-opening automatic doors.
- The door coupler can have a larger clearance, up to 2 or 3 times larger than in conventional door couplers, between the door coupler vanes and the rollers on the landing doors. A large clearance permits larger tolerances in the relative positions of the car and the elevator shaft, which in turn allows e.g. the use of a softer spring suspension of the elevator car. A large clearance could also permit a larger tolerance in the mounting of landing doors.
- A flat door coupler structure is achieved. This makes it easy to place the door coupler between the car door and landing door. A space saving may be achieved.
- The door coupler has a clear and simple structure, resulting in low manufacturing and installation costs and simple and easy maintenance.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention is described by the aid of a few examples of its embodiments by referring to the attached which are given by way of illustration only, and thus are not limitative of the present invention, and in which.

DETAILED DESCRIPTION OF THE PREFERRED EMBODIMENTS

Figure 1:
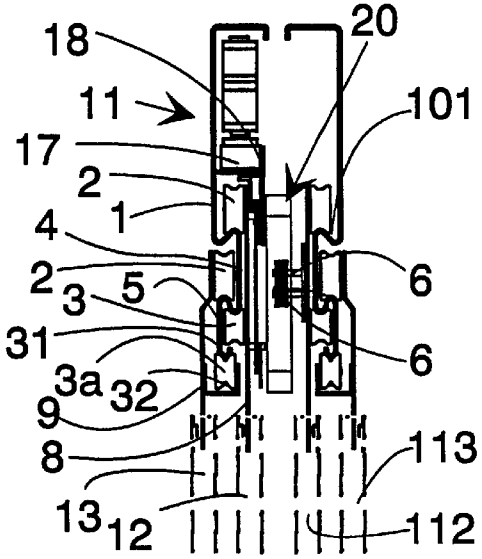
FIG. 1 presents a car door and landing door applying the invention, together with the supporting beam, seen from the direction of the end of the beam.
Figure 2:
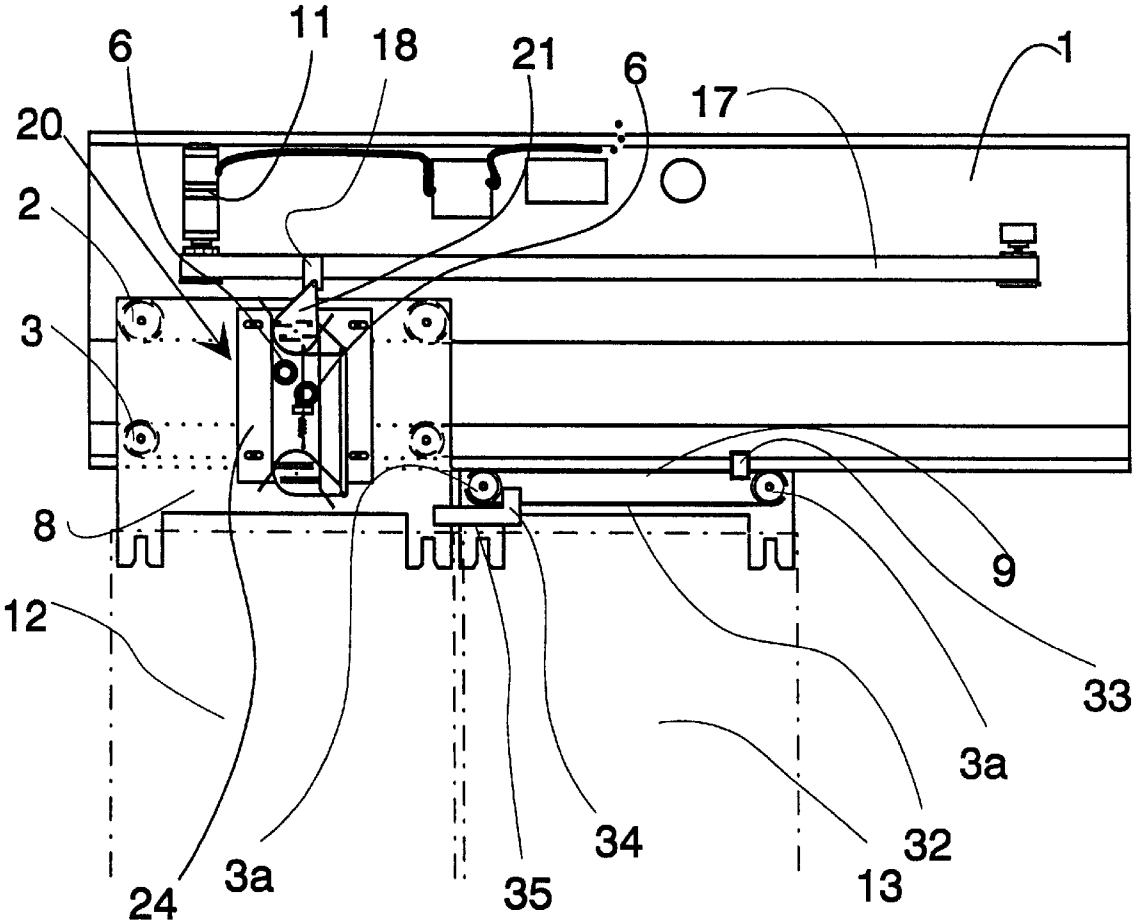
FIG. 2 presents a car door applying the invention, together with its supporting beam, as seen from the direction of the landing.

FIGS. 1 and 2 present the overhead supporting beam of a car door applying the invention and the suspension of the door panels 12 and 13 on the overhead supporting beam. FIG. 1 shows the structure as seen from the direction of the end of the beam and FIG. 2 shows it from the direction of the landing, i.e. from the side of the fast door panel 12. FIG. 1 shows the cross-sectional form of the overhead supporting beam as well as the locations of the rollers 2 supporting the door panels and those of their counter rollers 3,3*a* relative to the supporting beam 1. FIG. 1 also shows the landing door 112,113 together with its supporting structure 101. Formed in the supporting beam 1 are roller races 4,5 for rollers 2,3,3*a*. Suspended on the upper roller race 4 is the fast door panel 12 of a telescoping door while the slow door panel 13 is suspended on the lower roller race 5. The counter rollers 3*a* attached to the supporting plate 9 of the slow door panel 13 are provided with rope grooves 31, through which the synchronizing rope 32 is passed. The synchronizing rope 32 forms a loop which at one point 33 is immovably fixed to the roller race 5 or otherwise immovably fixed relative to the beam 1 and at another point 34 to a fixture 35 on the fast door panel 12. These points 33,34 move in opposite directions in relation to the slow plate 9 when the door is opened or closed, because they are attached to parts of the loop that move in opposite directions. Therefore, the fast door panel 12 with its supporting plate 8 and the slow door panel 13 with its supporting plate 9 move in synchronism aside from the door opening and back to close the door opening. A driving gear 11 drives a belt 17, which, via a connecting lever 21 comprised in the door coupler, further moves the supporting plate 8 of door panel 12. One end of the connecting lever is pivoted on an attachment point 18 on the belt 17. The other end of the connecting lever 21 is pivoted on the door coupler 20, more particularly on the base plate 24 of the door coupler. The landing door is provided with rollers 6 acting as counterparts of the door coupler 20. If the door coupler 20 is not aligned with the rollers 6, the door coupler has to be moved in relation to the car door in the direction of movement of the car door to eliminate the effect that a lateral deviation in relative positions of the car door and landing door would have on the operation of the door. When the door coupler 20 has been properly aligned with the rollers 6 acting as counterparts, the door coupler 20 is prevented from moving in relation to the car door. Complete closing and opening of the doors is achieved by keeping the car door, landing door and door coupler immovable with respect to each other throughout the duration of the opening and closing movement of the door.

Figure 3:
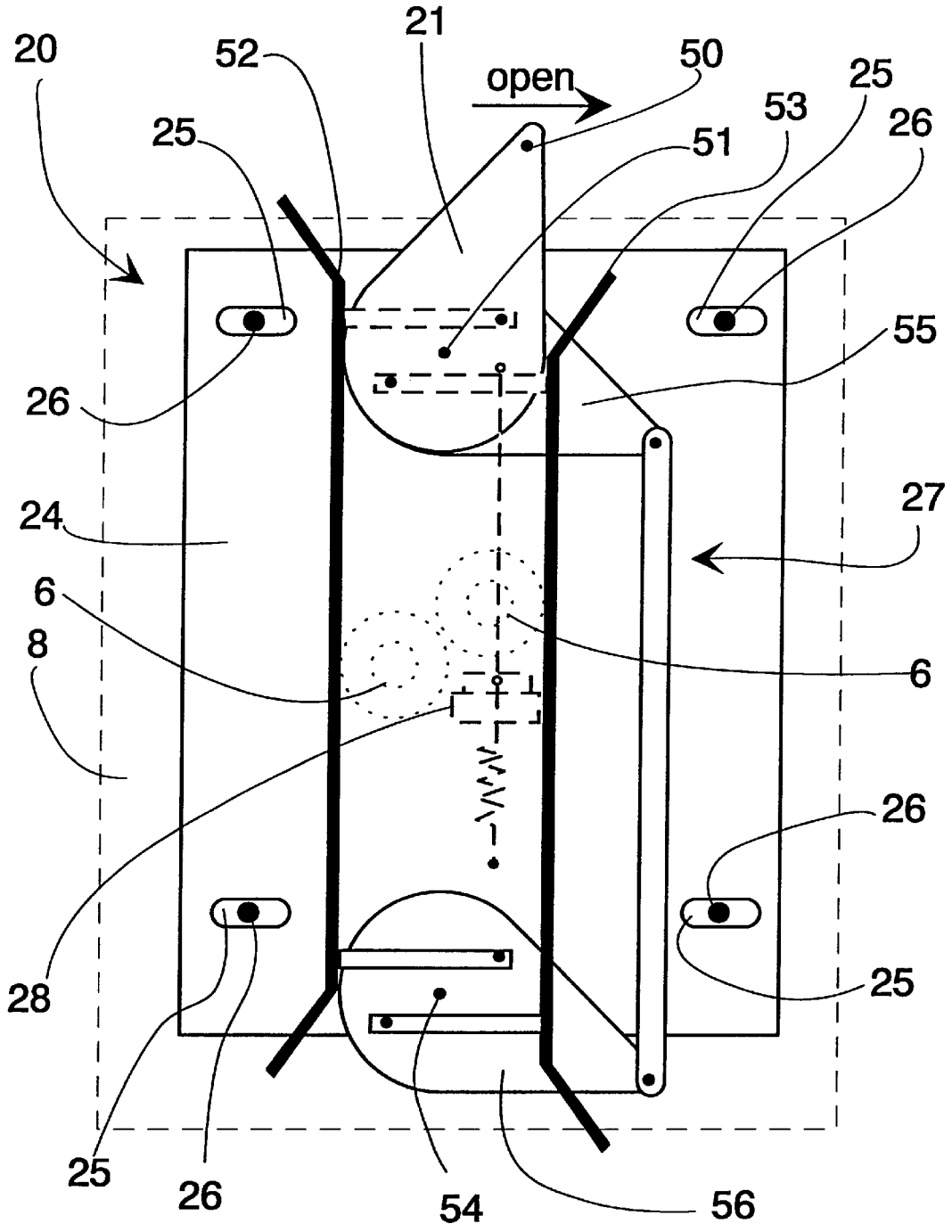
FIG. 3 presents a door coupler according to the invention, engaging the rollers on a landing door.
Figure 4:
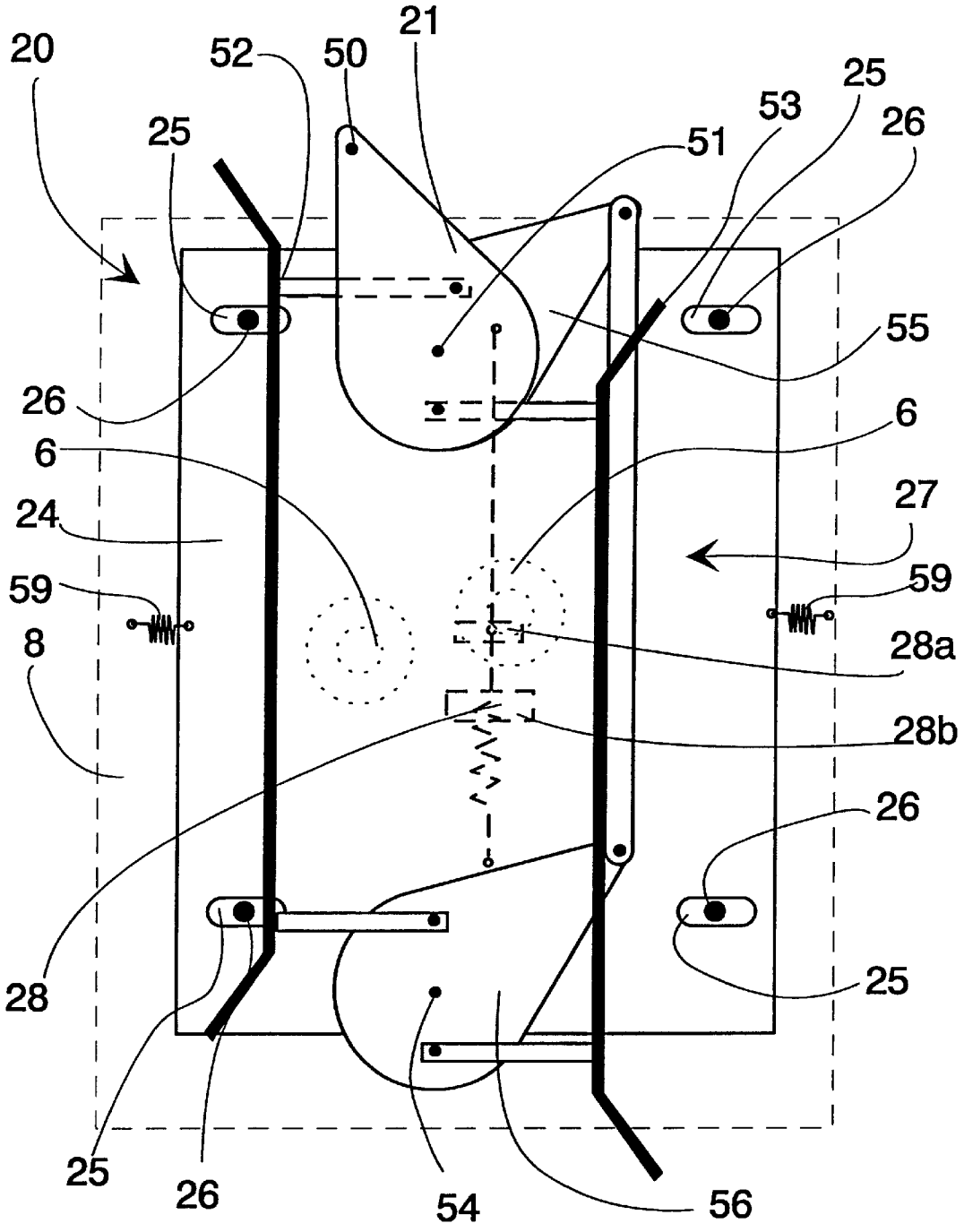
FIG. 4 presents the door coupler of FIG. 3 with the vanes open.

Referring to FIG. 3 and 4, the door coupler 20 is described in more detail. In FIG. 3, the door coupler has engaged the rollers on the landing door and in FIG. 4 the door is closed and the door coupler vanes are open, permitting the landing door rollers to pass between the vanes. Pivoted by one end on the door coupler base plate 24 is a connecting lever 21. When the connecting lever 21 turns about its pivot 51, it acts upon a linkage 27 used to open and close the gap between the door coupler vanes 52,53. The base plate 24 is supported by guide pieces 26 which are immovable in relation to the supporting plate 8 of the door. Preferably the guide pieces 26 are pins or the like fixed to the supporting plate and provided with a guide groove or other guiding element to keep the door supporting plate and the door coupler at a preset distance from each other. The guide pieces 26 extend into elongated holes 25 in the base plate. In relation to the supporting plate 8, the base plate 24 and therefore the whole door coupler is movable in the direction of the door movement within the limits prescribed by the length of the holes 25. When the doors are in their closed position, the gap between the vanes 52,53 of the door coupler 20 is open so that, as the elevator is moving, the rollers 6 acting as counterparts attached to the landing door are allowed to pass unobstructed between the vanes 52,53. When the elevator has stopped at a landing, the rollers 6 remain between the vanes 52,53. When the door is being opened, the motion of the belt 17 is transmitted to the door coupler 20 via a point of attachment 50, preferably a pivot, at one end of the connecting lever 21, causing the connecting lever 21 to turn about the pivot 51 at its other end. As it turns, the connecting lever 21 causes a first lever 55 acting on the first ends of the vanes 52,53 to turn about the pivot 51, said first lever 55 being attached to the connecting lever 21 or integrated with it. In synchronism with the first lever 55, a second lever 56 acting on the second ends of the vanes 52,53 turns about pivot 54. The first and second levers are connected by a synchronizing rod 75 designed to ensure that the levers 55,56 turn simultaneously. The use of a synchronizing rod allows a relatively light attachment of the vanes 52,53 to the levers 55,56. If a sufficiently strong attachment of the vanes to the levers is provided, a synchronizing rod is not necessarily needed. In FIG. 3, the direction of the belt movement opening the door is indicated by an arrow designated open. By means of the linkage 27, the gap between the vanes 52,53 is closed during the first stage of the belt movement opening the door. When one of the vanes 52,53 comes into contact with a counterpart roller 6 on the landing door, a supporting force is applied from the roller to the vane supported by the linkage 27, and further from the linkage to the base plate 24 via the pivots 51,54. As a result of the supporting force and the opening movement of the door, the door coupler 20, floating in relation to the supporting plate 8 and supported by the guide pieces 26, moves in the longitudinal direction of the holes 25 until both door coupler vanes 52,53 meet the rollers 6, the door coupler being thus exactly positioned as required by the rollers. The position of the door coupler relative to the rollers cannot change during the opening and closing movements of the door. When pressed between the vanes 52,53, the rollers may operate a landing door locking device, in which case the rollers may move horizontally towards each other. It is appropriate to take this movement of the rollers into account in the positioning of the door coupler. At the end of the closing motion of the vanes 52,53, a brake 28 locks the door coupler in position with respect to the supporting plate 8. The brake 28 is only closed after the door coupler has been positioned with respect to the landing door by the vanes 52,53 being closed against the rollers 6. The vanes 52,53 are held pressed against the rollers 6 during the whole opening and closing movement. In a preferred case, to ensure that the vanes will remain pressed against the rollers, the door coupler is provided with a blocking device or the like which only permits the vanes to move apart from the rollers when the doors are in their closed position. The brake 28 is presented in FIG. 3 and 4 in the form of a skeleton diagram.

When the brake is released, the brake part 28*b* attached to the supporting plate 8 of the car door and the brake part 28*a* attached to the door coupler move apart from each other, permitting the door coupler 20 and the supporting plate 8 to move in relation to each other. Instead of a brake, some other type of blocking device may be used, e.g. a latch. At the same time, the opening motion of the belt begins to move the supporting plate 8, thus opening the door. The opening movement of both the car door and the landing door has started simultaneously from a completely closed position.

Since the brake 28 locks the door coupler, which holds the landing door rollers 6 pressed between the vanes 52,53, in position relative to the supporting plate, the relative positions of the landing door and car door are maintained; in other words, the function of the brake is to keep the door coupler in the correct position relative to the car door during the opening and closing movement.

To close the door, the belt 17 is driven in the direction opposite to the opening movement. Once the door has been closed completely, the brake 28 is released and the vanes 52,53 move away from the rollers 6. As the brake has maintained the relative positions of the landing door and car door unchanged, both the car door and the landing door return to their completely closed position. The door coupler is preferably provided with return springs 59, which return the door coupler to its starting position with respect to the supporting plate 8 and therefore also with respect to the car door after the brake 28 has been released.

Figure 7:
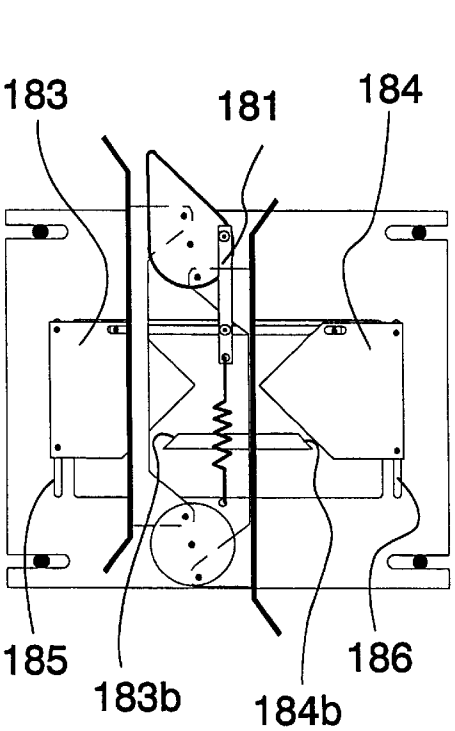
FIG. 7 presents the door coupler of FIG. 5 at the middle of its range of movement, with the vanes in their open position.
Figure 6:
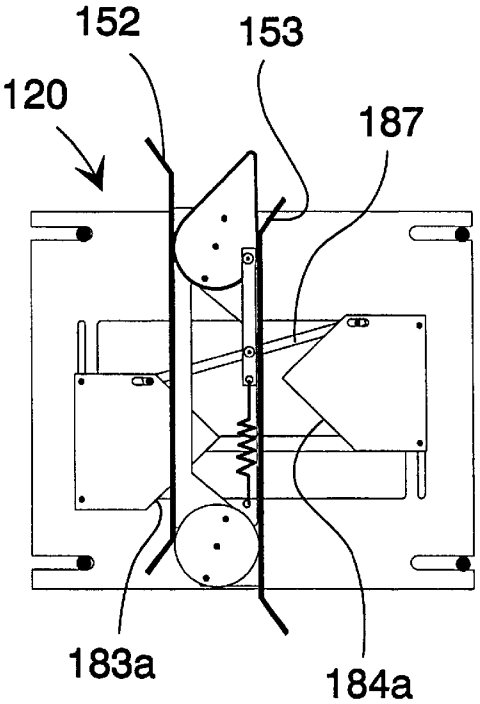
FIG. 6 presents the door coupler of FIG. 5 at the left extremity of its range of movement, with the vanes in their closed position
Figure 5:
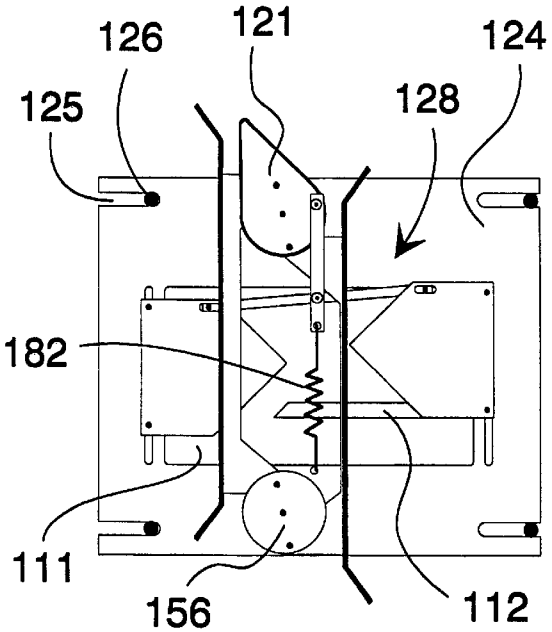
FIG. 5 presents another door coupler according to the invention, with the vanes open and at the left extremity of their range of movement.

Referring to FIG. 5–7, another door coupler 120 as provided by the invention is described. FIG. 5 shows the door coupler with its vanes 152,153 open and placed at the left extremity of their range of movement. In FIG. 6, the door coupler is at the left extremity of its range of movement, with the vanes 152,153 in their closed position. FIG. 7 shows the door coupler in the middle area of its range of movement, with the vanes 152,153 open. The range of movement of the door coupler is limited by means of slots 125 provided at the left and right edges of the door coupler base plate 124 and pins 126 supporting the door coupler on the car door, said pins 126 being immovable in relation to the car door.

Pivoted on the door coupler base plate 124 is a connecting lever 121. As the connecting lever 121 turns about its pivot in the base plate, it causes the vanes 152,153 eccentrically pivoted on the connecting lever to move, thus increasing and decreasing the gap between the vanes. In synchronism with the connecting lever, a second lever 156 acting on the second ends of the vanes 152,153 turns about its pivot in the base plate, the second ends of the vanes 152,153 being eccentrically pivoted on this second lever. In FIG. 5 and 7, the blocking device 128 is open, permitting the door coupler to move supported by the pins 126. In FIG. 6, the blocking device is closed, preventing relative motion of the door and the door coupler. The blocking device is operated by an arm 181, which is pivoted by its first end on the connecting lever 21 so that the turning motion of the connecting lever between its extreme positions produces a nearly linear, preferably vertical, back-and-forth movement of the arm 181. The back-and-forth movement of the arm 1 is loaded with a drawspring 182 in such a way that the load tends to draw the connecting lever in the direction closing the vanes 152,153. The base plate 124 is provided with brake lumps 183 and 184, which are movably attached to the base plate. The brake lumps move on slides or the like, guided by guide grooves 185,186 provided in the base plate, said guide grooves being substantially vertical and placed at a distance from each other. On the side facing towards the gap between them, the brake lumps have downward sloping braking surfaces 183*a* and 184*a*, preferably at an angle of 45 degrees. The brake lumps 183 and 184 partly cover an aperture 111 made in the base plate 124, through which aperture a fixed brake lump 112 extends into the space between the movable brake lumps 183,184. The fixed brake lump 112 is immovably mounted relative to the car door.

The fixed brake lump 112 has upwards sloping braking surfaces 183*b* and 184*b*, preferably at an angle of 45 degrees, which are pressed against the braking surfaces 183*a*,184*a* of the movable brake lumps 183,184 when the latter move downwards along the guide grooves 185,186 in the base plate. The brake lumps are connected by a connecting rod 187, which is pivoted by its first end on the first movable brake lump 183 and by its second end on the second movable brake lump 184. At its middle, the connecting rod is pivoted on the movable arm 181. The downward movement of the arm causes the movable brake lumps 183,184 of the door coupler, which is aligned with the rollers on the landing door, to move down against the fixed brake lump 112. Due to the rocking suspension of the brake lumps on the arm 181 and the guiding action of their guide grooves, the blocking device being locked does not change the alignment of the door coupler. As the blocking device has sloping braking surfaces 183*a*,183*b*,184*a*,184*b*, its locking action is just as effective regardless of the current position of the door coupler within its horizontal range of movement.

It is obvious to a person skilled in the art that different embodiments of the invention are not restricted to the examples described above, but that they may instead be varied in the scope of the claims presented below. For instance, the door coupler can be mounted in a different place on the car door than on the supporting plate, although it is customary for the door coupler to be mounted either on the door panel or on the door panel supporting plate. It is further obvious that the door may equally well be a side-opening or a center-opening automatic door.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A procedure for moving a landing door of an elevator by using movement of a car door, the procedure including the steps of:

providing a door coupler attached to the car door;

coupling the car door to the landing door with the door coupler when the elevator is stopped at a landing;

engaging a counterpart mounted on the landing door with gripping elements provided on the door coupler during the step of coupling;

aligning the door coupler according to a position of the counterpart by moving the door coupler in relation to the car door in a direction of car door movement; and preventing movement of the door coupler relative to the car door after the step of aligning.

2. The procedure as defined in claim 1, wherein the step of coupling the car and landing doors is simultaneously carried out with the step of aligning.

3. The procedure as defined in claim 1, further comprising the step of using the driving power for aligning the door coupler from an operating mechanism of the car door.

4. The procedure as defined in claim 1, further comprising the step of controlling the step of aligning by controlling supporting force applied by the counterpart to the gripping elements.

5. The procedure as defined in claim 1, further comprising the steps of:

interconnecting the door coupler and the car door by the door coupler so as to render the door coupler and the car door immovable relative to one another, the step of interconnecting occurring after the step of aligning; and keeping the door coupler and the car door immovable relative to one another during opening and closing movements of the car and landing doors.

6. A door coupler connected to a car door of an elevator, the door coupler comprising:

gripping elements for engaging a counterpart attached to a landing door when the elevator is stopped at a landing;

a blocking device to prevent relative motion between the door coupler and the car door, the door coupler being movably mounted relative to a direction of car door movement.

7. The door coupler as defined in claim 6, further comprising a supporting plate for the car door, the door coupler being attached to the supporting plate.

8. The door coupler as defined in claim 7, further comprising guide pieces which are immovable relative to the supporting plate.

9. The door coupler as defined in claim 8, wherein the guide pieces include pins which are attached to the supporting plate.

10. The door coupler as defined in claim 8, further comprising a base plate for the door coupler, the base plate being provided with elongated holes or slots into which the guide pieces are extend, the guide pieces being provided with at least one of a guide groove and other guiding element which fit in the holes or slots so as to keep the supporting plate and the door coupler at a preset distance from each other.

11. The door coupler as defined in claim 10, wherein play of the door coupler is determined by the holes or slots and the guide pieces.

12. The door coupler as defined in claim 11, wherein the guide pieces include pins which are attached to the supporting plate.

13. The door coupler as defined in claim 7, wherein the blocking device is a brake which acts on relative motion between the door coupler and the supporting plate of the door, the door coupler further comprising return springs for positioning the door coupler when the brake is in a released condition.

14. The door coupler as defined in claim 6, further comprising a supporting plate for the car door, the blocking device being a brake which acts on relative motion between the door coupler and the supporting plate of the door.

15. The door coupler as defined in claim 14, further comprising return springs operatively connected to the brake, the return springs positioning the door coupler when the brake is in a released condition.

* * * * *